United States Patent [19]

Teagno et al.

[11] 4,285,562

[45] Aug. 25, 1981

[54] DUAL PURPOSE ELECTRICAL CONNECTOR

[75] Inventors: Vladimiro Teagno; Franco Trevisiol, both of Turin, Italy

[73] Assignee: AMP Incorporated, Harrisburg, Pa.

[21] Appl. No.: 46,873

[22] Filed: Jun. 7, 1979

Related U.S. Application Data

[63] Continuation of Ser. No. 853,922, Nov. 22, 1977, abandoned.

[51] Int. Cl.[3] ..... H01R 27/00

[52] U.S. Cl. ..... 339/33; 339/258 P

[58] Field of Search ..... 339/32 R, 32 M, 176 MF, 339/176 MP, 258 R, 258 P, 33

[56] References Cited

U.S. PATENT DOCUMENTS

| | | | |
|---|---|---|---|
| 2,870,424 | 1/1959 | Franz | 339/258 P |
| 2,920,304 | 1/1960 | Webster | 339/258 P |
| 2,937,357 | 5/1960 | Kennedy | 339/17 |
| 3,149,897 | 9/1964 | Martineck | 339/176 MF |
| 3,277,425 | 10/1966 | Marshall et al. | 339/176 MF |
| 3,448,345 | 6/1969 | Koehler, Jr. et al. | 339/14 R |
| 3,725,843 | 4/1973 | Johnson | 339/176 MP |
| 4,053,197 | 10/1977 | Teagno | 339/99 R |

*Primary Examiner*—Neil Abrams

*Attorney, Agent, or Firm*—Frederick W. Raring

[57] ABSTRACT

A modular harness in which a series of conductors are terminated at opposite ends by identical connectors which are each adapted for connection alternatively to a printed circuit or tabs. The connectors may comprise a housing base having a longitudinally extending slot in a contact face communicating with two rows of longitudinally staggered terminal receiving compartments. The terminals preferably have contact portions with opposed spring arms to grip a tab between them, one arm being bent away from the other arm intermediate its ends to provide a contact surface for a printed circuit at the bend. The other arm may constitute a back-up spring during contact by the one arm with a printed circuit.

4 Claims, 10 Drawing Figures

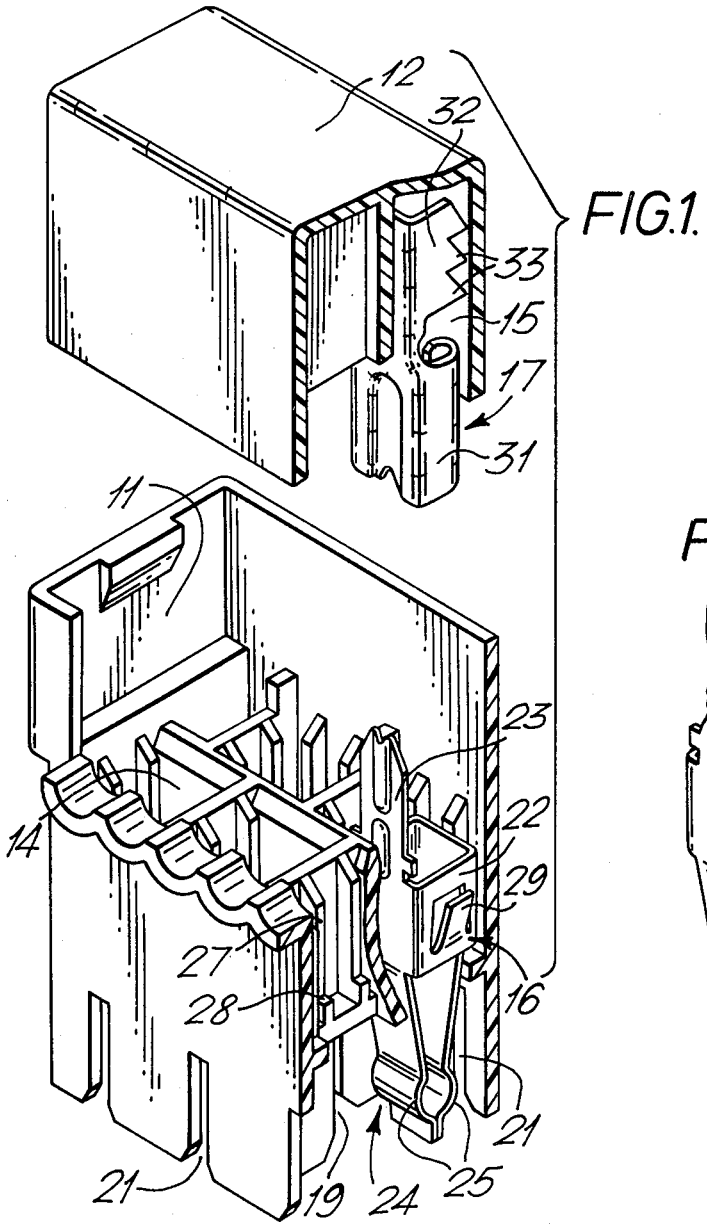
FIG.1.
FIG.2.
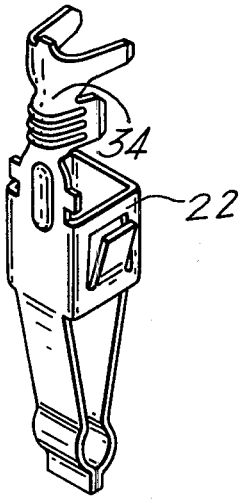

FIG.3.
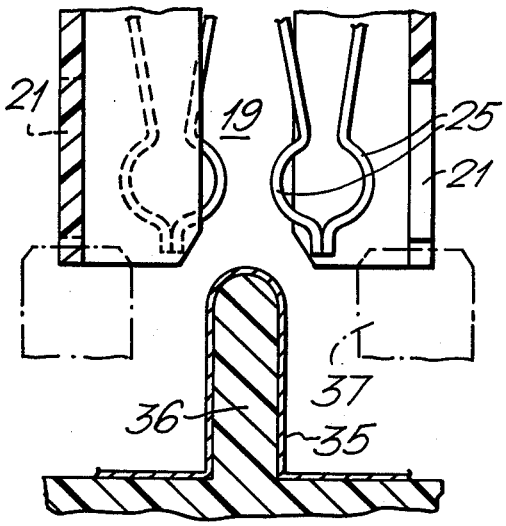
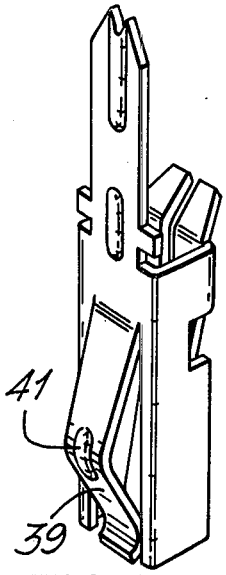
FIG.6.
FIG.4.
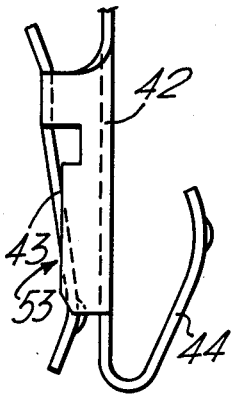
FIG.5.
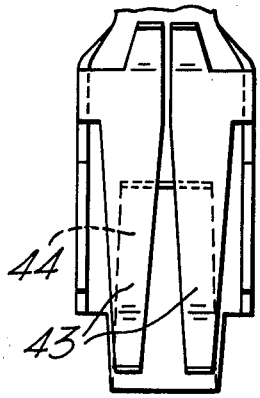
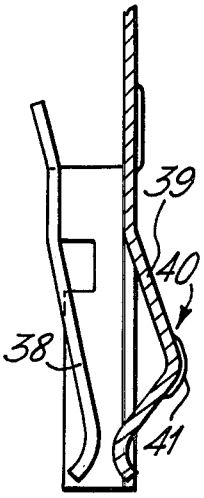
FIG.7.

DUAL PURPOSE ELECTRICAL CONNECTOR

This is a continuation of application Ser. No. 853,922, filed Nov. 22, 1977, now abandoned.

The invention relates to electrical harnesses and electrical connectors and terminals for such harnesses.

According to the invention, a modular electrical harness comprises a bundle of wires or series of conductors terminated at both ends by identical electrical connectors which are adapted to connect alternatively to printed circuits or to rows of tabs.

Thus, harnesses of the same construction can be used to connect to the conventional tab contacts or to printed circuits which are proposed with increasing frequency for example for instrument panels of automobiles. A printed circuit may be the edge of a rigid printed circuit board or an equivalent defined by a flexible printed circuit supported by a rigid strip.

According to another aspect of the invention, an electrical connector for a modular harness comprises an insulating housing formed with cavities retaining respective electrical terminals having wire connecting portions and contact portions integrally joined together by body portions, the contact portions protruding into a slot formed in the cavity walls to extend longitudinally of the housing and opening to a contact face of the housing for connection to a printed circuit received in the slot and being arranged to connect to tabs when inserted in the housing.

Where connection is to be made to a printed circuit board or ribbon cable in which the adjacent circuit paths or conductors are closely spaced, a problem arises in providing sufficient clearance between the adjacent terminals to avoid short circuits.

According to a preferred example of the invention, the connector is provided with two parallel rows of cavities, the cavities in one row being longitudinally offset from the cavities in the other row so that the terminals of respective rows are in staggered relation.

This permits the pitch of the contacts to be reduced to that of the circuit paths or conductors of the printed circuit board and ribbon cable without short circuits occurring. It also allows contacts of greater width, lengthwise of the row, than in a single row case so that the mechanical and electrical requirements of the contacts can more readily be accommodated.

In one example, the contact portions each comprise two spring arms extending in opposed relation from the body and converging towards their free ends, one arm protruding into the slot for connection to a printed circuit and the other arm being for connection to a tab.

Preferably, the free ends of the arms are arranged to be brought into abutment during engagement of the one arm with a printed circuit so that the other arm provides a back-up spring.

It is also preferred that the free ends of the arms have contact surfaces on two opposed sides, the arms gripping a tab inserted between the contact surfaces, the opposite side of the one arm having a contact surface for connection to a printed circuit.

The invention includes a terminal for an electrical connector which terminal is stamped and formed from a single piece of sheet metal and comprises a body portion from opposite ends of which extend a wire connecting portion and a contact portion, respectively, the contact portion comprising two spring arms extending in opposed relation from the body and converging towards their free ends which have contact surfaces on two opposed sides, the arms gripping a tab inserted between the contact surfaces, one arm being bent away from the other arm intermediate its ends and the opposite side of the arm at the bend having a contact surface for connection to a printed circuit.

Examples of the invention will now be described with reference to the accompanying drawings in which:

FIG. 1 is an exploded view partly in cross-section of a first example of connector;

FIG. 2 is a perspective view of a terminal of the connector of FIG. 1 but with a modified wire connecting portion;

FIG. 3 is a fragmentary cross-sectional view of a contact face of the connector of FIG. 1, showing two modes of use;

FIG. 4 is a side elevational view of a second example of terminal with the wire connecting portion omitted;

FIG. 5 is a front elevational view of the second example;

FIG. 6 is a rear perspective view of a third example of terminal;

FIG. 7 is a cross-sectional view of the third example;

Figure 9:
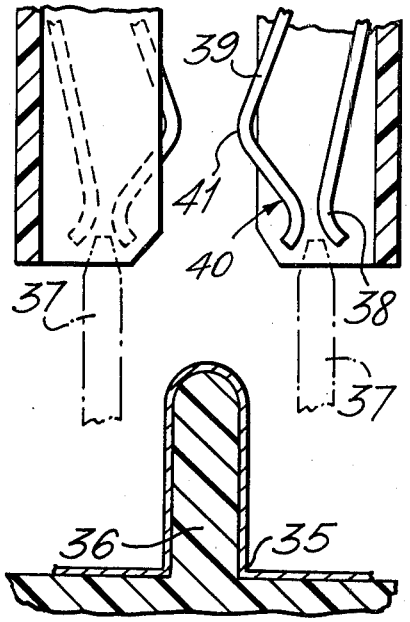
FIG. 9 is a fragmentary view of the contact face of the connector of FIGS. 6–8 showing two modes of use.

The connector of FIG. 1 comprises a housing base 11 and cover 12 moulded of plastics material with two rows of cavities 14 and 15, retaining terminals 16 and 17, the cavities of one row being longitudinally offset from the cavities of the other row so that the associated terminals are located in staggered relation. A slot 19 bisects longitudinally a contact face of the housing to communicate laterally with each cavity. Tab receiving slots 21 which open to the contact face are formed in the longitudinal walls of the housing communicating with each cavity and in correspondingly staggered relation.

Each terminal 16 is stamped and formed from a single piece of sheet metal stock and comprises a box-like body portion 22 from opposite ends of which extend a tab-like male wire connecting portion 23 and a contact portion 24 respectively. The contact portion comprises a pair of spring arms which extend from opposite sides of the body portion and converge towards their free ends which are formed with oppositely curved contact faces 25. The body portion is located in the housing by cooperation with ribs and shoulders 27 and 28 formed on the cavity walls and a locking lance 29 is struck out from at least one wall of the body portion for cooperation with a locking abutment (not shown) formed on a cavity wall.

The terminal 17 comprises a tab-receiving wire connecting portion 31 and an anchoring portion 32 having teeth 33. Instead of teeth, the anchoring portion may have opposite sides rolled over to form a split part-tubular spring received as an interference fit in the socket.

The cover can be applied to the base to engage the tab in the socket and connect to insulated wires located between them as described in our GB Patent application No. 32385/75 and in the corresponding U.S. Pat. No. 4,053,197. Alternatively, as in other examples the tab may be replaced by a conventional crimping ferrule 34 and the cover 12 and terminal 17 omitted.

After connection to the wires, the connector can be connected either to a printed circuit board or a flexible etched circuit 35 supported on a rib 36 and inserted to the longitudinal slot or to tabs 37 inserted into slots 21 as shown in FIG. 3. In either case the non-contacting spring arm provides a back-up spring increasing the stiffness of the contact portion.

The same connector can therefore be used to make connection either to tabs or to a printed circuit board, (or flexible etched circuitry where suitable supported). A particular application is in an automobile harness system where the same harness module can be used to interconnect the tabs or printed circuit board of a central junction box to the flexible etched circuitry of an instrument panel.

In a second example of contact shown in FIGS. 4 and 5 the contact portion 53 comprises a printed circuit contacting arm 44 constituted by a reversely bent extension of the base of a channel shaped body 42, and a tab can be gripped between the free ends of arms 43 and the channel base.

In a third example, the connector housing and terminals may be modified as shown in FIGS. 6 to 9. The contact portion 40 comprises contact spring arms 38 bent over from the free ends of the side walls and an opposed arm 39 is stuck from the base of a generally channel-shaped body portion, which arms converge at their free ends to grip between them a tab. The contact arm 39 is bent intermediate its ends to provide an outwardly protruding contact face 41 for connection to a printed circuit. In this example, the arm 38 functions as a back-up spring when the supported flexible etched circuit is received in the housing slot.

Figure 10:
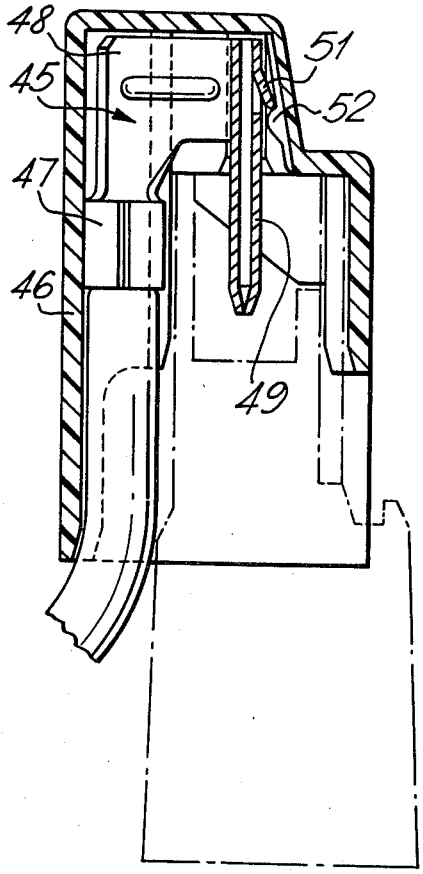
FIG. 10 is a cross-sectional view of an auxillary connector.
Figure 8:
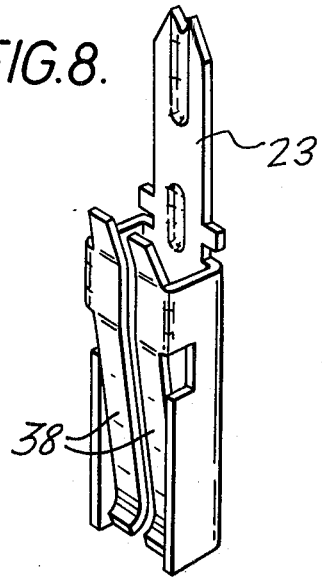
FIG. 8 is a front perspective view of the third example.

An advantage of using this form of contact is that the tabs can be more closely spaced together than with the previous example and lie wholly within the insulating housing after connections, (especially important where the tabs extend from a central junction box of an automobile). In addition, an insulated connection is provided, the longitudinal walls of the housing being imperforate.

Where individual components are to be connected to a harness connector their leads may be selectively terminated by the terminals 45 of FIG. 10 which are mounted in a row on insulating housing 46. The terminals comprise a crimping ferrule 47 extending from one end of a body 48 and a double thickness tab 49 extending transversely of the plane of the body, from the other end. The terminal is retained in the housing by engagement of a relatively rigid tooth 51 with a pip 52 moulded on the relatively flexible housing wall. The housing 46 can be coupled to a connector having a housing base as indicated in the dotted lines at 11 in FIG. 10.

It will be apparent from the foregoing and from an inspection of FIGS. 6–9 that the connector housing shown in FIG. 9 is of the known type which has a mating face, a trough-like recess extending into the mating face, and cavities on each side of this trough-like recess in which the terminals are disposed. The terminals are oriented such that their web portions are proximate to the sides of the trough-like recess and the second spring arms 39 are adjacent to the trough-like recess with the contact portions thereof extending into the recess. The first spring arms 38 are remote from the recess and the lower ends of these arms serve to support the ends of the second spring arms 39 against overstressing when a circuit board is inserted into the trough-like recess.

What we claim is:

1. A stamped and formed electrical terminal which is intended to be inserted into an insulating housing, said terminal being mateable with a terminal tab and being alternatively mateable with a conductor on a circuit board, said terminal comprising:

a channel-shaped body portion having a mating end and a rearward end, said body portion having a web and sidewalls, wire connecting means extending from said body portion at said rearward end, inwardly directed flanges extending from each of said sidewalls at said rearward end, first spring arms extending from each of said flanges to said mating end, said spring arms being inclined towards said web and being between said sidewalls, said spring arms having parallel adjacent side edges, a second spring arm struck from said web adjacent to said rearward end, said second spring arm being initially inclined outwardly from said web, said reversely curved intermediate its ends, and having a free end portion which is inclined towards said web whereby, said terminal is mateable with a flat terminal tab by relative movement of said tab between said first spring arms, and said second spring arm, and said terminal can be mated with a circuit board conductor by contacting the external surface of said second arm at the reversely curved portion with said circuit board conductor.

2. A multi-contact electrical connector of the type comprising an insulating housing having a mating face, a trough-like recess extending into mating face, a plurality of terminal-receiving cavities in said housing on at least one side of said recess, and electrical terminals in said cavities, each of said terminals having a channel-shaped body portion having a mating end and a rearward end, said body portion having a web and sidewall, said mating end of said terminal being proximate to said mating face of said housing, each of said terminals being oriented in its respective cavity with its web adjacent to said trough-like recess and said sidewalls extending inwardly of its associated cavity, each of said terminals having inwardly directed flanges extending from each of its sidewalls at its rearward end, first spring arms extending from each of said flanges towards said mating face of said housing, said first spring arms being between said sidewalls and being inclined towards said web, said first spring arms having parallel adjacent side edges, a second spring arm struck from said web adjacent to said rearward end, said second spring arm being initially inclined outwardly from said web and extending into said trough-like recess, said second spring arm being reversely bent intermediate its ends and having a free end portion which is inclined towards said web whereby, said terminals in said connector can be mated with terminal tabs upon relative movement of said tabs between said first spring arms and said second spring arms of said terminals, and said terminals in said connector can be mated with conductors on a circuit board upon movement of edge portions of said circuit board into said trough-like recess.

3. An electrical connector as set forth in claim 2, said housing having a plurality of terminal-receiving cavities and terminals on both sides of said recess.

4. An electrical connector as set forth in claim 3, said cavities on one side of said recess being offset relative to said cavities on the other side of said recess whereby said terminals are similarly offset.

* * * * *